US005620821A

United States Patent [19]

Ogura

[11] Patent Number: 5,620,821

[45] Date of Patent: Apr. 15, 1997

[54] METHOD OF FORMING TRANSPARENT COLOR IMAGE

[75] Inventor: Motohiro Ogura, Tokyo, Japan

[73] Assignee: Canon Kabushiki Kaisha, Tokyo, Japan

[21] Appl. No.: 638,232

[22] Filed: Apr. 26, 1996

[30] Foreign Application Priority Data

May 1, 1995 [JP] Japan ..... 7-107459

[51] Int. Cl.[6] ..... G03G 13/01; G03G 13/20

[52] U.S. Cl. ..... 430/42; 430/45; 430/124

[58] Field of Search ..... 430/42, 45, 124

[56] References Cited

U.S. PATENT DOCUMENTS

| | | | |
|---|---|---|---|
| 5,089,363 | 2/1992 | Rimai et al. | 430/45 |
| 5,229,188 | 7/1993 | Takeuchi et al. | 428/195 |
| 5,234,784 | 8/1993 | Aslam et al. | 430/45 |
| 5,281,504 | 1/1994 | Kanbayashi et al. | 430/124 |
| 5,352,553 | 10/1994 | Takeuchi et al. | 430/42 |

FOREIGN PATENT DOCUMENTS 2-263642 10/1990 Japan .

*Primary Examiner*—Roland Martin

*Attorney, Agent, or Firm*—Fitzpatrick, Cella, Harper & Scinto

[57] ABSTRACT

A method of forming a transparent color image by electrophotography using a transparent image supporting member, a surface of which is provided with a resin layer miscible with toner, wherein the softening point of the resin layer is arranged within a range of the softening point of the toner ±10° C. and the thickness d of the resin layer satisfies the following formulae:

$$D=2\times(1-\pi/4)\times(\text{average particle size of toner});$$

and $$D-(\text{average particle size of toner})/4\ \mu m \leqq d \leqq D+(\text{average particle size of toner})/4\ \mu m;$$

wherein D represents the optimum thickness of the resin layer.

14 Claims, 5 Drawing Sheets

D: OPTIMUM THICKNESS OF RESIN LAYER

To: SOFTENING POINT OF TONER

METHOD OF FORMING TRANSPARENT COLOR IMAGE

BACKGROUND OF THE INVENTION

1. Field of the Invention

The present invention relates to a method of forming a transparent color image using electro-photography.

2. Description of the Related Art

Conventionally, an image is commonly projected by using an over-head projector (hereinafter referred to OHP), which image has been obtained by forming a monochrome image on a transparent film (transparent base film) made of polyester, etc., by an electro-photographic apparatus.

However, when a full-color image is formed on a transparent film by dry developing and projected by the OHP, the thus-projected image becomes grayish and exhibits a very narrow range of color reproducibility.

This is because light is irregularly reflected by a roughness of the toner-image surface which has been caused during image-forming on the transparent base film. In other words, toner provided on the smooth transparent film does not satisfactorily melt or flow due to heating applied at the time of fixation. Thus, a particle form of the toner is maintained such that incident light is irregularly reflected thereby, and for instance, a shadow occurs on the screen, resulting in a deteriorated image. In particular, since the number of toner particles is small in half-tone portions having low image densities, light absorption by coloring agent or pigment included in the toner decreases to a level similar to that by the irregular reflection, therefore the color reproduction of the half-tone portions becomes grayish.

To solve the foregoing problems, Japanese Patent Laid-Open No. 2-263642 and U.S. Pat. No. 5,229,188 disclose methods of smoothing the surfaces of transparent image supporting members (transparent base films) by coating a resin miscible with toner. The transparency of the toner images is thereby improved and excellent projected images are achieved.

Meanwhile, among the color images, such images that have the highlighted portions require further transparency in the toner image so as to achieve excellent color reproducibility of the projected images.

SUMMARY OF THE INVENTION

It is an object of the present invention to provide a method of forming a transparent color image having excellent highlight reproducibility in a projected image. It is another object of the present invention to provide a reliable method of forming a transparent color image which can prevent offset.

The present invention relates to a method of forming a transparent color image by electro-photography using a transparent image supporting member, a surface of which is provided with a resin layer miscible with toner, wherein the softening point of the resin layer is arranged within a range of the softening point of the toner ±10° C. and the thickness d of the resin layer satisfies the following formulae:

$$D-(\text{average particle size of toner})/4\ \mu m \leqq d \leqq D+(\text{average particle size of toner})/4\ \mu m;$$

and $$D=2\times(1-\pi/4)\times(\text{average particle size of toner})\ \text{formula I};$$

wherein D represents the optimum thickness of the resin layer.

In a method of forming a transparent color image according to the present invention, the softening point and thickness of a resin layer of a transparent image supporting member are determined based on the softening point and the average particle size of the toner, respectively. The reproducibility of a color image is thereby improved in highlighted portions of a projected image. Since the thus-determined thickness of the resin layer of the transparent image supporting member is relatively thin when compared with the toner layer, the entrapped amount of the toner layer in the resin layer is small so that irregular reflection of incident light is reduced at the interface between the entrapped portions and the resin layer. Consequently, the transparency of the toner image is improved. Further, since the resin layer is thin, the color thereof does not affect the projected image, and in particular, the reproducibility of yellow is improved in the highlighted portions. Moreover, for the same reason, the adhesion of the resin layer to the transparent image supporting member is also improved, thus more reliably preventing offset from occurring at the time of fixation.

Further objects, features and advantages of the present invention will become apparent from the following description of the preferred embodiments with reference to the attached drawings.

BRIEF DESCRIPTION OF THE DRAWINGS

FIG. 1(*c*) illustrates an alternative embodiment including an adhesion layer 6 disposed between a transparent image supporting member 1 and a resin layer 4.

DESCRIPTION OF THE PREFERRED EMBODIMENTS

A resin miscible with a toner is used as a resin layer forming the surface layer of a transparent image supporting member. Further, the softening point of the resin layer is required to be within a range of the softening point of the toner ±10° C. Consequently, a polyester resin is preferably used, and a polyester resin similar to that used for the toner, as will be described later, is applicable.

The thickness of the above mentioned resin layer d must satisfy the following formulae:

$$D-(\text{average particle size of toner})/4\ \mu m \leqq d \leqq D+(\text{average particle size of toner})/4\ \mu m;$$

and $$D=2\times(1-\pi/4)\times(\text{average particle size of toner})\ \text{formula I};$$

wherein the D value represents the optimum thickness of the resin layer.

Figures 1A, 1B:
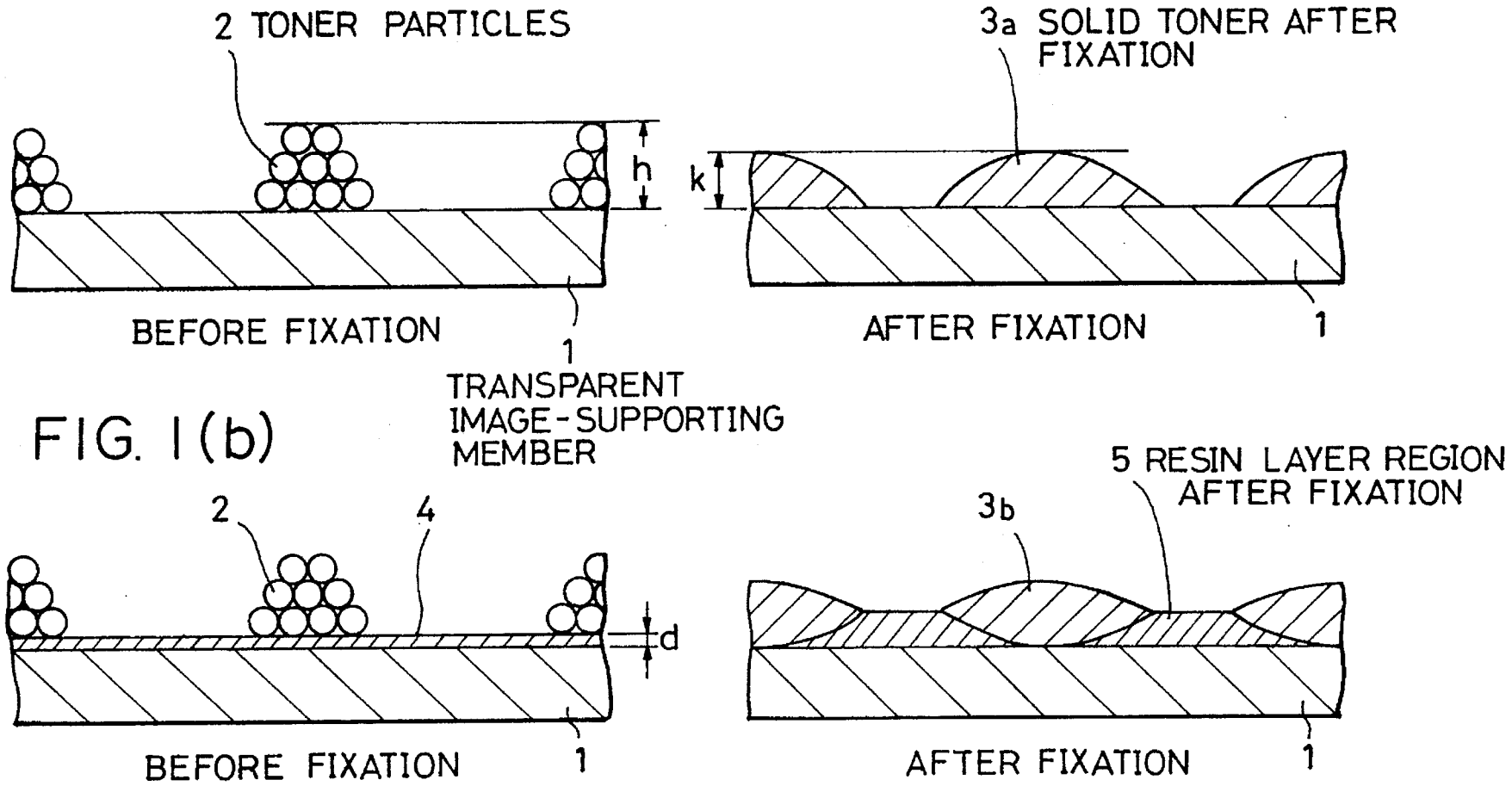
FIG. 1*a* illustrates a transparent image supporting member 1 which has not been provided with a resin layer 4.
FIG. 1*b* indicates a transparent image supporting member 1 which has been provided with a resin layer 4.

The thickness of the resin layer d will be explained below with reference to the attached drawings. FIG. 1 (including FIGS. 1(*a*), 1(*b*), and 1(*c*)) is a diagrammatic view showing a transparent image supporting member 1 before and after fixation. FIG. 1*a* illustrates a transparent image supporting member 1 which has not been provided with a resin layer 4, FIG. 1*b* illustrates a transparent image supporting member 1 which has been provided with the resin layer 4. FIG. 1(*c*) illustrates an alternative embodiment including an adhesion layer disposed between the transparent image supporting member and the resin layer.

The thickness d of the resin layer 4 is affected by the thermal characteristics, such as the softening point, of the toner particles 2 and the thickness h of the toner powder before fixation. In a digital image obtained by electrophotography, irregularity of the toner image particularly increases in the highlighted portion. The surface of the image becomes rough in such a portion, thus incident light is irregularly reflected and the amount of light participating in projecting the image is reduced, resulting in a dark projected image. When indicating the irregularity of the toner image by the average roughness Rz obtained by measuring 10 points of the transparent image supporting member, the Rz value of after fixation is approximately one half of that obtained before fixation if the toner has sharp melt characteristics, which will be explained later. Since the projected image becomes remarkably dark when the Rz value exceeds 3 μm, it is necessary to maintain the Rz value at 3 μm or less, and preferably, 2 μm or less to avoid a dark image. Although the foregoing object can be similarly achieved by decreasing the thickness h of the toner powder before fixation, this solution is not preferable. This is because the coloring-agent content of the toner must be raised to decrease the h value, which provides difficulty in controlling the tone between the most highlighted portion and the solid image.

According to the present invention, a smooth surface is achieved by controlling the maximum height k of the solid toner 3*a* after fixation, corresponding to the roughness Rz of a toner image, and the thickness d of the resin layer 4, and further, by setting the softening point of the resin layer 4 within a range of the softening point of the toner ±10° C. In other words, the toner thereby spreads further laterally while moving downward during the fixation process, and solid toner 3*b* after fixation is formed as shown in FIG. 1*b*. Similarly, portions of the resin layer 4 positioned under the toner particles are displaced by the toner particles and piled up to form resin-layer regions 5 after fixation, as is shown in FIG. 1*b*. Consequently, it becomes possible to reduce the Rz value to 3 μm or less.

In addition, according to the inventors of the present invention, it has been known that the maximum height k of the solid toner after fixation is approximately twice the average size of the toner particles. Therefore, assuming that the sectional contours of the solid toner after fixation form circular arcs, the optimum thickness D of the resin layer 4 is obtained from the foregoing formula I.

For instance, when the maximum height k of the solid toner after fixation is approximately 8 μm, i.e., the average size of the toner particles is approximately 4 μm, and they form isolated lines in the image, (D+1) μm is the upper limit of the thickness d of the resin layer. Meanwhile, if they form crowded continuous lines in the image, (D−1) μm is the lower limit of the thickness d of the resin layer. Thus, the thickness d of the resin layer is required to be within a range of D±1 μm, wherein the optimum thickness D of the resin layer is obtained from the foregoing formula I.

The preferable thickness of the resin layer 4 is between 1 and 6 μm. When the thickness excessively increases, the color of the resin per se becomes apparent, and more particularly, it affects the highlight reproducibility of yellow. Furthermore, offset readily occurs. Meanwhile, if the resin layer 4 is too thin, the advantages of the present invention are not satisfactorily achieved.

Figure 2:
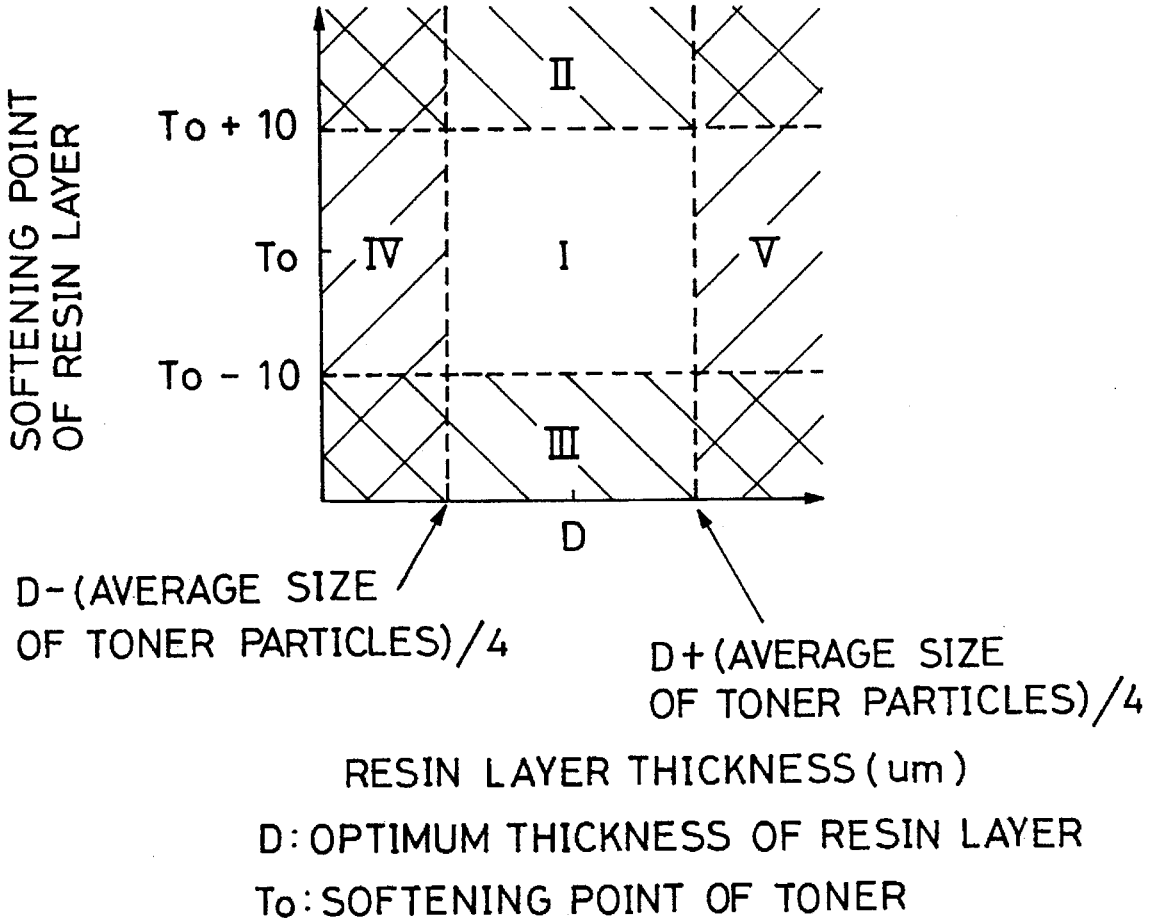
FIG. 2 shows the setting conditions for a method of the present invention.

The thickness d and the softening point of the resin layer 4, which has been described as above, will be further explained referring to FIG. 2. In FIG. 2, the resin layer is not satisfactorily miscible with the toner in region II, at which the softening point of the resin layer exceeds the temperature of $T_o$−10° C., wherein $T_o$ represents the toner softening point. Offset of the resin layer per se occur in region III, at which the softening point of the resin layer is lower than the temperature of $T_o$−10° C. Additionally, in region IV in which the thickness d is less than {D−(average particle size of toner)/4} μm, the resin of the resin layer 4 cannot satisfactorily compensate for the gaps of the solid toner 3*a* because the solid toner is not completely embedded in the resin layer 4. Meanwhile, the solid toner is completely embedded in resin layer 4 in the region V in which the thickness d is larger than {D+(average particle size of toner)/4} μm, however color reproducibility is deteriorated because of the influences of the resin color of the resin layer 4 or the thickness of the pigment included in the toner. Therefore, the optimum conditions for a method of the present invention correspond to region I in FIG. 2, and it is required to form color transparent images within this region.

In a method of the present invention, the average size of the toner particles in the formula I is measured according to the following method.

A Coulter Counter TA-II manufactured by the Coulter Company is used for measurement and it is connected with an interface manufactured by Nikkaki K. K. and a CX-1 personal computer manufactured by Canon to output the distributions and the averages of numbers and volumes for data analysis.

For measurement, 0.1 to 5 ml of a surfactant, preferably an alkylbenzene sulfonate, are added to 100 to 150 ml of an 1% NaCl aqueous solution as a dispersing agent. Then, 0.5 to 50 mg, and preferably 2 to 20 mg, of toner are added. The thus-obtained electrolytic solution containing suspended toner is subjected to dispersion for approximately 1 to 3 minutes by using an ultrasonic agitator. The particle size distribution of particles each having a diameter of 1 to 40 μm is determined by using the above-mentioned Coulter Counter TA-II with an aperture of 100 μm. The volume—average size is finally calculated and regarded as the average size of the toner particle.

According to the present invention, the resin layer 4 is obtained by the following method: First, a resin to be used for the resin layer 4 is dissolved in a volatile organic solvent, such as alcohol including methanol and ethanol, or ketone including methylethyl ketone and acetone. Then the resultant solution is coated on a transparent image supporting member 1 (transparent base film) by bar coating, dipping, spraying, spin coating, or the like, followed by drying.

If required, an adhesion layer 6 may be provided between the resin layer 4 and the transparent image supporting member 1 to improve the adhesion therebetween so as to prevent the image from stripping at the time of fixation or after fixation (FIG. 1(*c*). The adhesion layer 6 is preferably composed of a material having high thermal resistance and miscible with both the transparent image supporting member 1 and the resin layer 4. Examples of such materials are ester resin, acrylate resin, methacrylate resin, styrene-acrylate ester copolymer, styrene-methacrylate ester copolymer, and the like.

Next, toner used for a method of the present invention will be explained as follows.

The average size of the toner particles is preferably 3 to 10 μm. If the average size is not in the foregoing range, the advantages of the present invention are not satisfactorily achieved.

Further, the toner used for the present invention is required to have excellent characteristics in melting and color mixing when heat is applied thereto, and further, to exhibit a low softening point and sharp melt characteristics with a short melting time.

By employing toner with sharp melt characteristics, the color reproducibility range of a copy becomes wider, resulting in an image faithful to the full-color original document. To produce such toner having sharp melt characteristics, a binding resin including a polyester resin, an epoxy resin, and a styrene-acrylic resin, a coloring agent, including a pigment and a sublimating pigment, a charging controlling agent and the like are dissolved and mixed together, followed by pulverization and classification. Processes of adding various kinds of additives may be employed if required.

Considering the fixation and the sharp melt characteristics, in particular, a polyester resin is preferably used as the binder resin for the toner employed in a method of the present invention. The polyester resin is synthesized from a diol compound and a dicarboxylic acid compound (copolycondensation). Particularly, a bisphenol derivative having the following formula II or a substituted compound thereof preferable is used as the diol component:

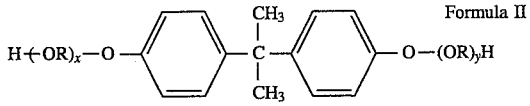

wherein R is an ethylene or propylene group, x and y are independently integers of at least 1, and the average value of x+y is from 2 to 10. A di- or higher carboxylic acid, an acid anhydride thereof, a lower alkyl ester thereof or the like is preferably used as the carboxylic acid component. Examples of such a carboxylic acid component are fumaric acid, maleic acid, maleic acid anhydride, phthalic acid, terephthalic acid, trimellitic acid, pyromellitic acid, and the like. Those carboxylic acid components may be used alone or as a mixture thereof.

The softening point of the polyester resin forming the toner used in a method of the present invention is preferably in a range of from 60° to 150° C., and more preferably, in a range of from 80° to 120° C.

Figure 3:
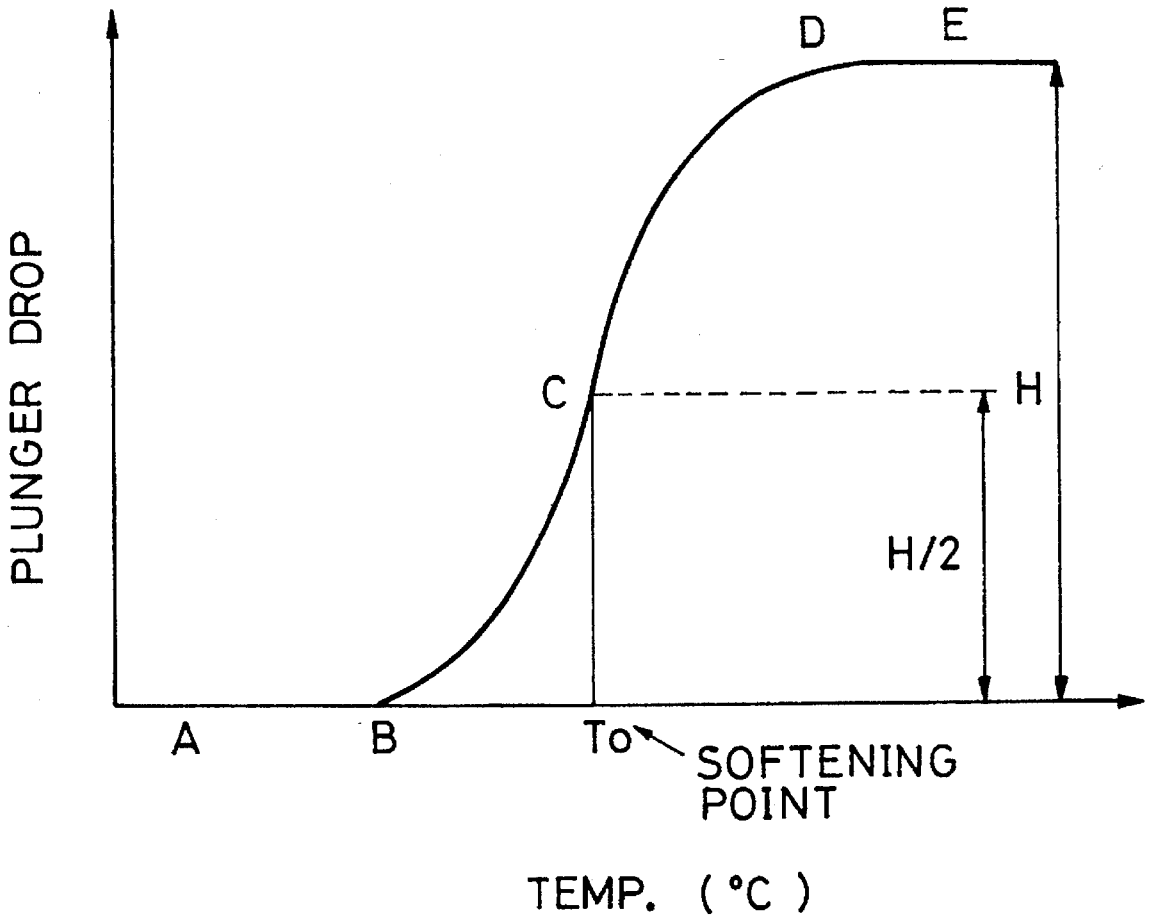
FIG. 3 is a 'plunger drop—temperature curve (softening sigmoid curve)' showing the softening characteristics of a toner used for the present invention.

The softening point of a toner used for a method of the present invention or the ester forming the toner is measured and determined as follows. FIG. 3 shows the softening characteristics of the toner containing the above polyester resin as a binder resin. The softening characteristics, that is, the plunger drop—temperature curve (hereinafter referred to as a softening sigmoid curve) is estimated by a Flow Tester CFT-500 which is manufactured by Shimadzu Seisakusho K. K. and equipped with a die (nozzle) having a diameter of 0.5 mm and a thickness of 1.0 mm. After preheating for 300 seconds at a initial setting temperature of 80° C., the measurement is carried out under a load of 50 kg while raising the temperature at a constant rate of 5° C./min. one to three of finely powdered toner is accurately weighed out. In this measurement, the cross section of the plunger is 10 $cm^2$.

After heating is started, the toner is gradually heated corresponding to the constant temperature raising and it starts melting and flowing which is illustrated as the points A to B of the softening sigmoid curve in FIG. 3. The melted toner largely flows due to further heating, which is illustrated as the points B to C to D, and finally, the plunger drop is stopped, which is illustrated as the points D to E. The height H of the softening sigmoid curve corresponds to the total flow and the temperature $T_o$ at the point C corresponds to one half of the H value thereby indicating the softening point of the toner.

The thermal melt characteristics, e.g., the softening point, of the resin, consisting of the adhesion resin, or the resin layer 4, can be evaluated according to the foregoing measurement.

In a method of the present invention, toner having sharp melt characteristics means toner satisfying the following formulae III:

$$|\Delta T| = |T1 - T2| = 5 \text{ to } 30°\ C.;$$

and $$T1 = 90 \text{ to } 150°\ C.;$$

wherein T1 and T2 are the temperatures when the melting viscosity is $10^5$ cp and $5\times10^4$ cp, respectively.

The foregoing toner with sharp melt characteristics exhibits a significantly sharp decrease in viscosity due to heating. Excellent subtractive color mixing is thereby achieved because mixing between the top and bottom layers is suitably achieved during the fixation process and the transparency of the toner layer itself is rapidly increased due to the decrease in viscosity.

It is preferable that a transparent image supporting member 1 (transparent base film) is not largely deformed by heating at the time of fixation and has thermal resistance such that it can be used at 100° C. or more. For example, polyethylene terephthalate (PET), polyamide, or polyimide may be employed. Among these, polyethylene terephthalate is most preferable in thermal resistance and transparency. The thickness of the transparent image supporting member 1 is preferably 50 μm or more so as to avoid wrinkles even if the supporting member 1 becomes soft due to heating accompanied by the fixation process. However, light transmittance decreases corresponding to an increase in the thickness. The upper limit of the thickness of the transparent image supporting member 1 is thus 200 μm or less, and more preferably, 150 μm or less.

Finally, a explanation will be made concerning an electrophotographic apparatus used for a method of the present invention.

Figure 4:
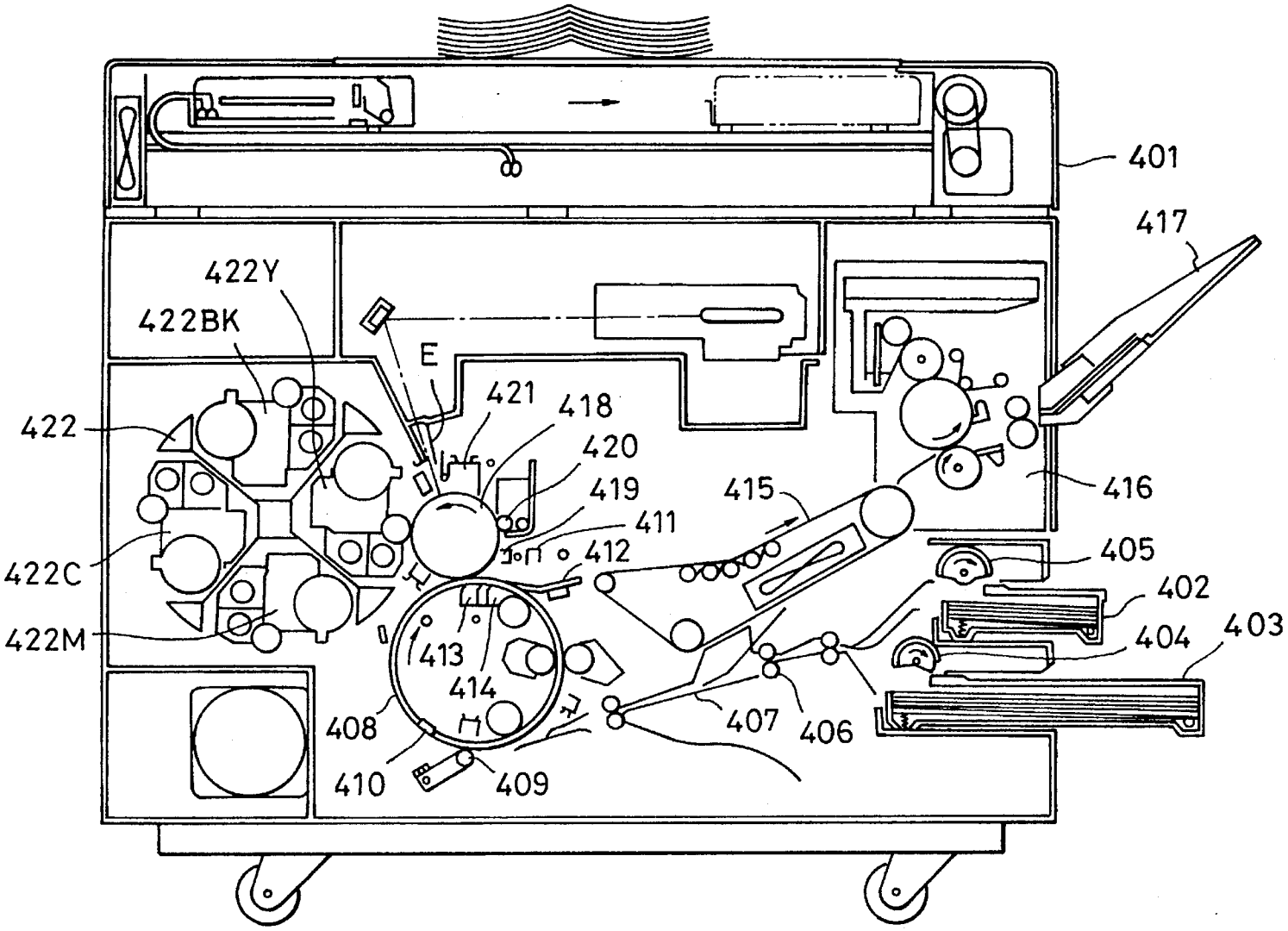
FIG. 4 is a diagrammatic sectional view showing an electro-photographic apparatus employed for a method of the present invention.

FIG. 4 is a diagrammatic sectional view showing an electro-photographic apparatus employed for a method of the present invention. The electro-photographic apparatus shown in FIG. 4 mainly is composed of a transfer material feeding unit extending from the right side of the apparatus body 401, i.e., the right side of FIG. 4, to the center of the apparatus body, a latent image forming unit set up near a transfer drum 408 situated in the center of the apparatus body 401, and a developer unit (a rotating developer unit) placed near the latent image forming unit. Hereinafter, 'transfer material' refers to the transparent image supporting member processed according to a method of the present invention.

The transfer material feeding system has the following structure: an opening is formed on the right side (the right side of FIG. 2) of the apparatus body, detachable transfer-material supply trays 402 and 403 provided for different sizes of the transfer materials are mounted in the opening, and feeding rollers 404 and 405 are respectively placed above the corresponding supply trays 402 and 403. The transfer material is fed to the transfer drum 408 by a paper feeding guide 407 equipped with a paper feeding roller 406. A contacting roller 409, a gripper 410, a charging device 411 for separating the transfer material, and a scraper 412 are placed adjacent to the outer peripheral surface of the transfer drum 408. A transfer charging device 413 and a charging device 414 for separating the transfer material are placed inside of the transfer drum 408. A feeding belt means 415 is provided close to the scraper 412. A fuser 416 is placed at the terminal side of the transfer material feeding direction of the feeding belt means 415, which is indicated by an arrow in FIG. 4, means in order to fix the color toner image on the transfer material. The fixed material is fed to a detachable ejection tray 417 mounted at the outside of the apparatus body 401.

In the latent image forming unit, a photosensitive drum 418 holding the latent image is placed in contact with the outer peripheral surface of the transfer drum 408. A charging device 419 for erasing, a cleaning means 420, and a first charging device 421 are placed near the outer peripheral surface of the photosensitive drum 418. In addition, an image exposure means, such as a laser beam scanner, for forming an electrostatic latent image, and an image exposure reflecting means, such as a polygonal mirror, are mounted on the outer peripheral surface of the photosensitive drum 418.

The developer unit (rotating developer unit) is positioned opposed to the outer peripheral surface of the photosensitive drum 418 and it visualizes, i.e., develops, the electrostatic latent image formed on the outer peripheral surface of the photosensitive drum 418. Such a rotating developer unit is equipped with a rotating body 422, which can freely rotate and has a yellow developer unit 422Y, a magenta developer unit 422M, a cyan developer unit 422C, and a black developer unit 422BK mounted therein.

An example of a sequence of the imaging process in an electro-photographic apparatus having the foregoing construction will now be explained for the full-color mode. When the photosensitive drum 418 rotates in the direction as indicated by the arrow in the FIG. 4, a photosensitive substance on the photosensitive drum 418 is uniformly charged by the first charging device 421. After that, an image is exposed by laser light E modified by a yellow image signal from the original document. Then an electrostatic latent image is formed on the photosensitive drum 418 so as to be developed by the yellow developer unit 422Y arranged at the developing position in advance by rotating the rotating body 422.

Meanwhile, the transfer material is fed through the paper feeding guide 407 having the paper feeding roller 406, held by the gripper 410 at a predetermined timing, and is electrostatically wound around the transfer drum 408 by the contacting roller 409 and an electrode opposed thereto. The transfer drum 408 rotates in the direction indicated by the arrow in synchronization with the photosensitive drum 418. Thus, by the transfer charging device 413, the image developed by the yellow developer unit 422Y is transferred to the transfer material at the position where the outer peripheral surfaces of the photosensitive drum 418 and the transfer drum 408 are in contact with each other. The transfer drum 408 continues rotating to provide the next color transfer (magenta in FIG. 4). The photosensitive drum 418 is discharged using the charging device 419 for erasing, cleaned up by the cleaning means 420, and then re-charged by the first charging device 421 so as to expose an image utilizing the next magenta image signal. While the electrostatic latent image is formed on the photosensitive drum 418 by the image exposure according to the magenta image signal, the rotating developer unit rotates such that the magenta developer unit 422M is arranged at the above-mentioned predetermined developing position for developing using the magenta toner. The above process is repeated for the cyan and black colors. After that, the transfer material, onto which the four-color developed image has been transferred, is discharged by the charging devices 411 and 414 for separating the transfer material, released from the gripper 410, and separated from the transfer drum 408 by the scraper 412, followed by feeding to the fuser 416 by the feeding belt means 415. Finally, the desired full-color image is achieved by fixation with heat and pressure in the fuser.

EXAMPLES

The present invention will be described in detail with particular reference to certain preferred examples thereof, but it will be understood that variations and modifications can be effected within the spirit and scope of the invention.

First Example

A transparent image supporting member was prepared from a biaxially oriented PET film, which was 100 μm thick and could be used at 150° C. maximum. A polyester resin layer (resin layer 4) was formed on the supporting member, which layer was made of a polyester resin having a softening point of 97° C. and a solubility parameter of approximately 11.0. To prepare the polyester resin layer, a polyester was dissolved in acetone and the resultant solution was coated on the PET film by bar coating, followed by drying. The thickness of the thus-obtained polyester layer was 3 μm.

For this example, such toner was employed that exhibited sharp melt characteristics and contained a polyester resin as a binder resin. The softening point of the toner was 97° C. and the average particle size thereof was 8 μm.

On the thus-obtained film (transfer material), a full-color image was formed by an electro-photographic apparatus (a CLC-550 manufactured by Canon) and projected by a 088-type OHP manufactured by 3M. As a result, the toner image on the film was faithfully projected, providing an excellent projected image. The transmittance of a solid image in the projected image was measured to 90% by a reflectance densitometer when the image density of the solid image was measured to 0.8 by a Macbeth Densitometer manufactured by Nippon Bunko Co.

Second Example

A method incorporated in the present invention was carried out in a manner similar to the first example, except that a pigment and an additive were blended with the binder resin of the toner used in the first example so that the softening point of the toner was set to 107° C. The particle size of the toner was 8 μm on an average.

When the toner image on the film was projected similarly to the first example, an excellent and faithful projected image was obtained. The transmittance of the image was 80% when it was measured by the same method as the first example.

Third Example

A method incorporated in the present invention was carried out in a manner similar to the first example, except that the toner used in this example had a softening point of 90° C. and contained an epoxy resin as the resin component. The particle size of the toner was 8 μm on a average.

When the toner image on the film was projected similarly to the first example, an excellent and faithful projected image was obtained. The transmittance of the image was 87% when it was measured by the same method as the first example.

First Comparative Example

A method incorporated in the present invention was carried out in a manner similar to the first example, except that the resin forming the resin layer 4 was a polyester resin having a softening point of 120° C. The highlighted portions of the projected image became dark and the transmittance of the image was 80%.

Second Comparative Example

A method incorporated in the present invention was carried out in a manner similar to the first example, except that the resin forming the resin layer 4 was a polyester resin having a softening point of 70° C. Offset occurred at the time of image forming by the electro-photographic apparatus because the polyester layer 4 had been stripped from the PET film.

Third Comparative Example

A method incorporated in the present invention was carried out in a manner similar to the first example, except that the thickness of the resin layer 24 was 10 μm. The highlighted portions of the projected image became dark and the transmittance of the image was 80%.

What is claimed is:

1. A method of forming a transparent color image by electro-photography using a transparent image supporting member, a surface of which is provided with a resin layer miscible with toner, wherein the softening point of said resin layer is arranged within a range of the softening point of said toner ±10° C. and the thickness d of said resin layer satisfies the following formulae:

$$D-(\text{average particle size of toner})/4\ \mu m \leqq d \leqq D+(\text{average particle size of toner})/4\ \mu m;$$

and $$D=2\times(1-\pi/4)\times(\text{average particle size of toner});$$

wherein D represents the optimum thickness of said resin layer.

2. A method of forming a transparent color image as set forth in claim 1, wherein the thickness of said resin layer is 1 to 6 μm.

3. A method of forming a transparent color image as set forth in claim 1, wherein said toner has sharp melt characteristics.

4. A method of forming a transparent color image as set forth in claim 1, wherein the average particle size of said toner is from 3 to 10 μm.

5. A method of forming a transparent color image as set forth in claim 1, wherein said resin layer is a polyester resin layer.

6. A method of forming a transparent color image as set forth in claim 1, wherein said toner contains a polyester resin as a binder resin.

7. A method of forming a transparent color image as set forth in claim 5, wherein said toner contains a polyester resin as a binder resin.

8. A method of forming a transparent color image as set forth in claim 3, wherein the roughness of a toner image is 3 μm or less.

9. A method of forming a transparent color image as set forth in claim 3, wherein the roughness of a toner image is 2 μm or less.

10. A method of forming a transparent color image as set forth in claim 1, wherein an adhesion layer is provided between said image supporting member and said resin layer.

11. A method of forming a transparent color image as set forth in claim 5, wherein the softening point of said polyester resin layer is in range of from 60° C. to 150° C.

12. A method of forming a transparent color image as set forth in claim 11, wherein the softening point of said polyester resin layer is in a range of from 80° C. to 120° C.

13. A method of forming a transparent color image as set forth in claim 1, wherein the thickness of said transparent image supporting member is in a range of from 50 μm to 200 μm.

14. A method of forming a transparent color image as set forth in claim 13, wherein the thickness of said transparent image supporting member is in a range of from 50 μm to 150 μm.

* * * * *

UNITED STATES PATENT AND TRADEMARK OFFICE

CERTIFICATE OF CORRECTION

PATENT NO. : 5,620,821

DATED : April 15, 1997

INVENTOR(S) : MOTOHIRO OGURA

It is certified that error appears in the above-identified patent and that said Letters Patent is hereby corrected as shown below:

COLUMN 2

Figure 1C:
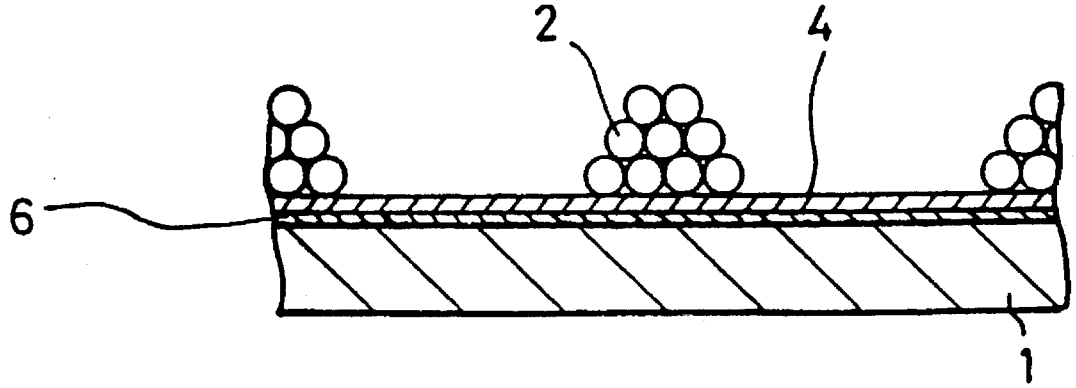
FIG. 1 is a diagrammatic view showing a transparent image supporting member 1 (including FIGS. 1(*a*), 1(*b*), and 1(*c*)) before and after fixation.

Line 30, "FIG. 1" should read --FIG. 1 (including FIGS. 1(a), 1(b) and 1(c))--.

COLUMN 3

Line 25, "sharp" should read --"sharp--.
Line 26, "characteristics," should read --characteristics",--.

COLUMN 4

Line 40, "an" (second occurrence) should read --a--.

UNITED STATES PATENT AND TRADEMARK OFFICE

CERTIFICATE OF CORRECTION

PATENT NO. : 5,620,821 Page 2 of 2

DATED : April 15, 1997

INVENTOR(S) : MOTOHIRO OGURA

It is certified that error appears in the above-indentified patent and that said Letters Patent is hereby corrected as shown below:

COLUMN 5

Line 62, "one" should read --One--.
Line 63, "three" should read --three g--.

COLUMN 6

Line 47, "a" should be deleted.
Line 65, "FIG. 2)" should read --FIG. 4)--.

Signed and Sealed this

Ninth Day of December, 1997

Bruce Lehman

*Attest:*

BRUCE LEHMAN

*Attesting Officer*

*Commissioner of Patents and Trademarks*